US007971300B2

(12) United States Patent
Wilker, Jr.

(10) Patent No.: US 7,971,300 B2
(45) Date of Patent: Jul. 5, 2011

(54) AIR CONTROL SYSTEM FOR THERAPEUTIC SUPPORT SURFACES

(75) Inventor: John B Wilker, Jr., Dillsboro, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 151 days.

(21) Appl. No.: 11/869,291

(22) Filed: Oct. 9, 2007

(65) Prior Publication Data

US 2009/0093912 A1 Apr. 9, 2009

(51) Int. Cl.
*A47C 27/08* (2006.01)

(52) U.S. Cl. ..... 5/713; 5/655.3; 5/710

(58) Field of Classification Search ..... 5/655.3, 5/706, 710, 713

See application file for complete search history.

(56) References Cited

U.S. PATENT DOCUMENTS

| | | | | |
|---|---|---|---|---|
| 4,745,647 | A * | 5/1988 | Goodwin | 5/713 |
| 5,249,319 | A * | 10/1993 | Higgs | 5/714 |
| 5,542,136 | A | 8/1996 | Tappel | |
| 5,771,511 | A * | 6/1998 | Kummer et al. | 5/600 |
| 6,353,950 | B1 * | 3/2002 | Bartlett et al. | 5/617 |
| 6,729,863 | B2 | 5/2004 | Scholz | |
| 7,284,291 | B2 * | 10/2007 | Wang | 5/713 |
| 7,296,312 | B2 * | 11/2007 | Menkedick et al. | 5/611 |
| 7,409,735 | B2 * | 8/2008 | Kramer et al. | 5/713 |
| 7,536,739 | B2 * | 5/2009 | Poulos | 5/710 |
| 2006/0112489 | A1 | 6/2006 | Bobey et al. | |
| 2008/0052837 | A1 * | 3/2008 | Blumberg | 5/727 |

FOREIGN PATENT DOCUMENTS

| | | |
|---|---|---|
| WO | WO 97/48314 | 12/1997 |
| WO | WO 2006/023479 A2 | 3/2006 |

OTHER PUBLICATIONS

"Rotary Lobe Static Compression System", Reitschle WEB Products—Rotary Lobe (1 page) (from http://www.rietschle.com/rietschle/web/products/home.nsf/contentview), (accessed Sep. 13, 2007).

"Combination Pressure/Vacuum Pump Listings", Copyright © 2001, Rietschle, Inc. (1 page) (from http://www.rietschlepumps.com/products/list-product.asp?Category=Vacuum/Pressure).

"Dental, Medical & Laboratory "Quiet, Reliable, Efficient, Space-Saving Designs"", Copyright © 2001, Rietschle, Inc. (2 pages) (from http://www.rietschlepumps.com/industries/Dental.asp).

Archive News Story "Rotary Lobe Blower in 6 in. long and weighs 1.75 lb.", Apr. 27, 2005, (4 pages) (from http://news.thomasnet.com/fullstory).

Partial European Search Report for Application No. 08253254.0, dated Nov. 10, 2009, (6 pages).

* cited by examiner

*Primary Examiner* — Robert G Santos
*Assistant Examiner* — Nicholas Polito
(74) *Attorney, Agent, or Firm* — Barnes & Thornburg LLP

(57) ABSTRACT

This disclosure describes a patient support surface having a cover defining an interior region, with a plurality of inflatable zones and a plurality of control nodes located within the interior region. Each control node comprises an air control system including an air supply and a processor.

21 Claims, 8 Drawing Sheets

AIR CONTROL SYSTEM FOR THERAPEUTIC SUPPORT SURFACES

RELATED APPLICATIONS

The present application is related to U.S. patent application Ser. No. 11/324,520, filed Jan. 3, 2006, entitled PATIENT SUPPORT and U.S. patent application Ser. No. 11/781,309, filed Jul. 23, 2007, entitled PATIENT SUPPORT, both of which are incorporated herein by this reference.

BACKGROUND

This disclosure relates to a device for supporting a patient, such as a bed or mattress. In particular, this disclosure relates to patient supports appropriate for use in hospitals, acute care facilities, and other patient care environments. More particularly, this disclosure relates to support surfaces that have one or more inflatable sections, and inflation and deflation of at least one of the inflatable sections is automatically controlled by an air control system.

SUMMARY

This disclosure describes a patient support surface including a cover defining an interior region, a plurality of inflatable zones located in the interior region, and a plurality of air control nodes located in the interior region, where each node is associated with a zone, and each node includes an air supply pneumatically coupled to one of the zones and a processor operable to execute programming logic configured to control air flow between the air supply and the zone. Each node may include a micro-sized vacuum/blower. Each node may include a node identifier that is different from the other node identifiers. Each node may include a network interface to communicate with the other nodes over a network.

The support surface may include control circuitry configured to provide communication between control nodes and an external bed network. The support surface may include at least one user interface to selectively control the nodes by a user.

The support surface may include a plurality of pressure sensors that are in data communication with the control nodes, wherein the sensors are configured to sense pressure in the inflatable zones and output signals indicative of sensed pressure values to the control nodes, and the programming logic is applied to the sensed pressure values to control air flow to and from the zones.

The support surface may include a plurality of force sensors in data communication with the control nodes, wherein the force sensors are configured to sense force applied to the inflatable zones and output signals indicative of the sensed force values to the control nodes, and the programming logic is applied to the sensed force values to control air flow to and from the zones. Each node may include a recordable medium and the programming logic may be stored in the recordable medium of the control node.

This disclosure also describes a mattress assembly, including a cover defining interior region, where the interior region includes a plurality of inflatable zones including a head zone configured to support an upper body portion of a patient and a seat zone configured to support a seat portion of a patient, each of the zones has a first side and a second side transversely spaced from the first side, a non-inflatable support member positioned adjacent one of the sides of the inflatable zones along a longitudinal axis of the mattress assembly, where the non-inflatable support member includes at least one control node operably coupled to at least one of the zones to control air flow in the at least one inflatable zones. The control node may be located adjacent one of the longitudinal sides of the head zone of the mattress assembly. The non-inflatable support member may include foam and may include a recess sized to receive the control node. The control node may include a micro-sized vacuum/blower and a processor configured to control operation of the micro-sized vacuum/blower. The control node may be located in an interior region of the non-inflatable support member.

This disclosure further describes an air control system for a patient support surface having a plurality of bladder assemblies, where the air control system includes a first control node including a first memory, a first node identifier stored in the first memory, a first pneumatic coupling configured to couple the first control node to a first bladder assembly of a patient support surface, a first air supply configured to supply air flow to the first bladder assembly via the first pneumatic coupling, a first processor configured to receive air control data, apply first air control logic to the air control data, and control operation of the first air supply in consideration of the air control data, a second control node including a second memory, a second node identifier stored in the second memory, the second node identifier being different than the first node identifier, a second pneumatic coupling configured to couple the second control node to a second bladder assembly of a patient support surface, a second air supply configured to supply air flow to the second bladder assembly via the second pneumatic coupling, a second processor configured to receive air control data, apply second air control logic to the air control data, and control operation of the second air supply in consideration of the air control data, and a communication link configured to permit electronic communication between the first control node and the second control node. The air control data may include sensed bladder pressure in a bladder assembly. The air control data may include sensed force applied to a bladder assembly. The air control data may include data relating to a third bladder assembly. The air control data may include data relating to a position of a bed frame section relative to the horizontal.

This disclosure also describes a method of controlling air flow in a patient support having a plurality of inflatable zones, where the method includes receiving at a first control node pressure data indicative of an internal pressure of a first inflatable zone, receiving at the first control node data indicative of an occurrence of an event triggering adjustment of the internal pressure of the first inflatable zone, applying first control logic to the data, operating an air supply provided at the first control node to adjust the internal pressure of the first inflatable zone, receiving at a second control node pressure data indicative of an internal pressure of a second inflatable zone, receiving at the second control node data indicative of an occurrence of an event triggering adjustment of the internal pressure of the second inflatable zone, applying second control logic to the data, and operating an air supply provided at the second control node to adjust the internal pressure of the second inflatable zone. The method may also include sending an output signal from the first control node to the second control node over a network. The method may also include sending an output signal from the first control node to a bed frame over a network.

This disclosure also describes a patient support apparatus including a mattress having a plurality of inflatable bladder assemblies, and an air control system operably coupled to the mattress, where the air control system including a plurality of control nodes, and each control node includes an air supply and a processor configured to control air flow between the air supply and one of the bladder assemblies. Each of the plurality of control nodes may include a network interface and each of the plurality of control nodes may be in data communication with the other control nodes via a first network. The apparatus may include control circuitry configured to link the first network with a second network. The second network may be an external network associated with a bed frame. The control nodes may be configured to receive signals indicative of a condition of the bed frame.

Patentable subject matter relating to the present invention may include one or more features or combinations of features shown or described anywhere in this disclosure, including but not limited to the written description and drawings, which may be pointed out by the claims.

BRIEF DESCRIPTION OF THE DRAWINGS

The detailed description of the drawings refers to the accompanying figures, in which.

DETAILED DESCRIPTION OF THE DRAWINGS

Figure 1:
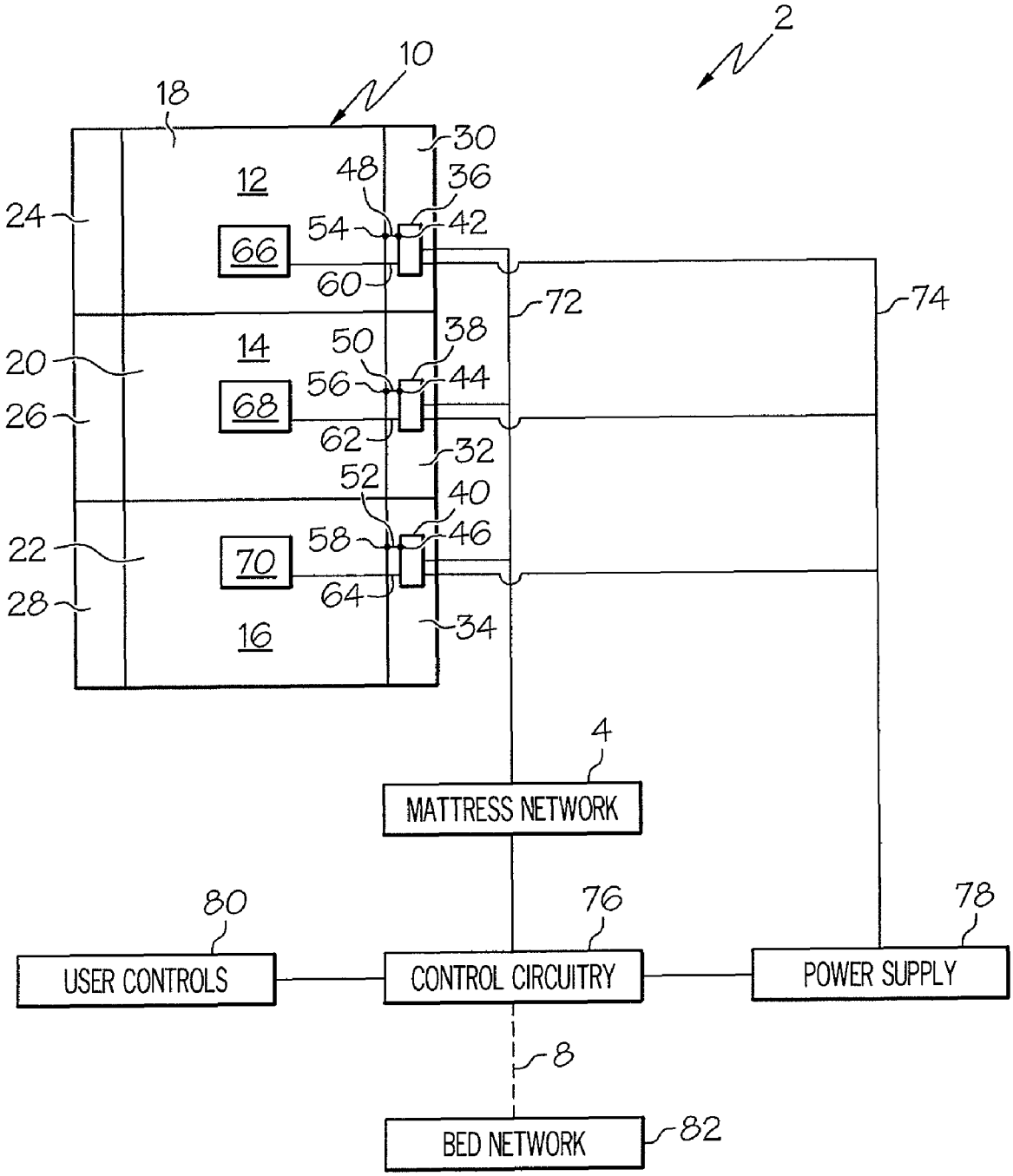
FIG. 1 is a schematic diagram of a patient support apparatus including a plurality of inflatable zones pneumatically coupled to an air control system including a plurality of independently operable control nodes, wherein the control nodes are operably coupled to a communication network.

In FIG. 1, a schematic of a patient support apparatus 10 including a plurality of mattress sections 12, 14, 16 is shown. Each of the mattress sections 12, 14, 16 includes an inflatable zone or bladder assembly 18, 20, 22. Inflation and deflation of each bladder assembly 18, 20, 22 is automatically controlled by an air control system 2. The air control system 2 operates to control the internal air pressure in each inflatable zone 18, 20, 22. Each zone may be controlled independently of or in concert with one or more of the other inflatable zones.

The patient support apparatus 10 also includes a plurality of support members 24, 26, 28, 30, 32, 34. Support members or "packaging" 24, 26, 28, 30, 32, 34 are located adjacent the longitudinal sides of the bladder assemblies 18, 20, 22. Support members 24, 26, 28, 30, 32, 34 are generally comprised of a non-inflatable support material such as foam. Accordingly, in the embodiment of FIG. 1, each mattress section 12, 14, 16 includes a bladder assembly (18, 20, 22) and at least two transversely spaced non-inflatable support members (24, 26, 28, 30, 32, 34), which are located on either longitudinal side of the bladder assembly.

Air control system 2 includes a plurality of control nodes 36, 38, 40. Each control node 36, 38, 40 is associated with a mattress section 12, 14, 16. In particular, each control node 36, 38, 40 is dedicated to controlling inflation and deflation of an inflatable zone 18, 20, 22 of a corresponding mattress section 12, 14, 16. Control nodes 36, 38, 40 are generally installed adjacent to or within their corresponding mattress section 12, 14, 16. As shown in FIG. 1, control nodes 36, 38, 40, are located proximate to support members 30, 32, 34 of the patient support apparatus 10. Control nodes 36, 38, 40 may be integral with or embedded in an interior region of one or more of support members 24, 26, 28, 30, 32, 34.

Each control node 36, 38, 40 is pneumatically coupled to a corresponding bladder assembly 18, 20, 22. Head section control node 36 has a head inlet/outlet port 42 that is in pneumatic communication with head bladder inlet/outlet port 54 via air conduit 48. Seat section control node 38 has a seat inlet/outlet port 44 that is in pneumatic communication with seat bladder inlet/outlet port 56 via air conduit 50. Foot section control node 40 has a foot inlet/outlet port 46 that is in pneumatic communication with seat bladder inlet/outlet port 58 via air conduit 52. A power supply 78 is operably coupled by power conduit(s) 74 to provide power to the air control system 2.

In the embodiment of FIG. 1, each mattress section 12, 14, 16 also includes a sensor assembly 66, 68, 70. Each sensor assembly 66, 68, 70 includes a pressure sensor that is configured to sense the internal pressure of air within its corresponding bladder assembly 18, 20, 22 and report these pressure readings back to the respective control node 36, 38, 40 via a sensor signal transmitted over a data link 60, 62, 64. Each control node 36, 38, 40 monitors the pressure readings from its corresponding bladder assembly 18, 20, 22, applies programming logic to determine whether the bladder assembly 18, 20, 22 needs to be inflated or deflated, and then initiates inflation or deflation as may be needed via air conduits 48, 50, 52.

Control nodes 36, 38, 40 are also in communication with microprocessor-driven control circuitry 76, which links the air control system 2 to an external network 82 via a communication link 8. In this way, inflation or deflation of the various inflatable zones 18, 20, 22 of the patient support apparatus 10 may be affected by conditions external to the bladder assemblies.

For instance, in FIG. 1, external network 82 is a communication network of a bed frame. Communication link 8 and control circuitry 76 are configured to receive and process data relating to aspects of a bed frame transmitted over bed network 82. As an example, a signal may be generated by a bed frame controller if a section of the bed frame has been articulated. A signal may be generated when the head section of a bed frame is elevated above 30 degrees with respect to the horizontal. Such information may be transmitted to air control system 2 via network 82 and link 8. Control circuitry 76 and/or programming logic provided in one or more of the control nodes 36, 38, 40 may process the head of bed frame angle information and determine that an adjustment in the internal air pressure of one or more of the bladder assemblies 18, 20, 22 is needed.

The control node(s) associated with the affected bladder assembly(ies) may then cause an appropriate inflation or deflation to occur in the associated mattress section. For example, it may be desirable to increase air pressure in seat section bladder assembly 20 if the head of bed frame angle has increased. In such event, a control signal is sent by control circuitry 76 to control node 38, and control node 38 causes the pressure in bladder assembly 20 to increase.

Likewise, conditions or events relating to the patient support surface 10 may be communicated to a bed frame via control circuitry 76, link 8 and network 82 in the reverse fashion. For example, if a certain mattress therapy, such as turning assistance, maximum inflate, pressure relief, percussion and vibration, or rotation, is in progress, this information may be communicated by one or more of the control nodes 36, 38, 40 to the bed frame via bed network 82. In response, the bed frame may issue a caregiver alert or other signal or indicator, or temporarily disable a bed frame function. For example, if a turning or rotation function of the mattress is in progress, the siderails of the bed may be prevented from lowering. An example of a bed communication network is shown and described in U.S. Pat. No. 6,897,780, to Ulrich, et al., titled BED STATUS INFORMATION SYSTEM FOR HOSPITAL BEDS, which is incorporated by reference herein.

Control circuitry 76 also links user controls 80 with air control system 2. User controls 80 may be provided on a user interface accessible by a caregiver or a patient to control the inflation and deflation of one or more of the bladder assemblies 18, 20, 22. For example, a caregiver may activate a mattress therapy for the patient, or the patient may wish to adjust the air pressure in one or more of the bladder sections for comfort or other reasons. The user interface may provide information and controls in the form of graphical icons, textual information, audio, video, or other forms of content. Activation of user controls 80 may be implemented using a touchcreen, hardpanel buttons, switches, or the like.

With the control of the air system localized to one or more individual control nodes 36, 38, 40, only the control node or node associated with the affected zones are implicated as needed. For example, if the user desires only to decrease the pressure in foot section bladders 22, then only control node 40 will be implicated and control circuitry 76 will relay instructions from user controls 80 to control node 40 in the form of a control signal. In this way, system resources may be conserved. In addition, the localized control of the zone or zones may allow faster response time. For example, faster inflation or deflation may be achieved in response to a triggering event, such as a force or pressure signal or articulation of a bed section. The disclosed system is configurable to provide localized control (i.e. articulation, inflation, and/or deflation) of one or more inflatable mattress segments or bladder assemblies.

When more than one node is required (i.e., when a mattress has more than one inflatable zone, as in FIG. 1), the nodes 36, 38, 40 are electrically connected to a mattress network 4 as shown in FIG. 1. The mattress network 4 is connected to bed frame network 82 via control circuitry 76. Network 4 is configured to enable communication with a variety of different interfaces including, but not limited to, Echelon, CAN, SPI, and LIN. The interoperability of the communication interfaces is configured to enable the patient support apparatus to be used with a variety of bed frame configurations without adversely affecting the features described in this disclosure.

Figure 2:
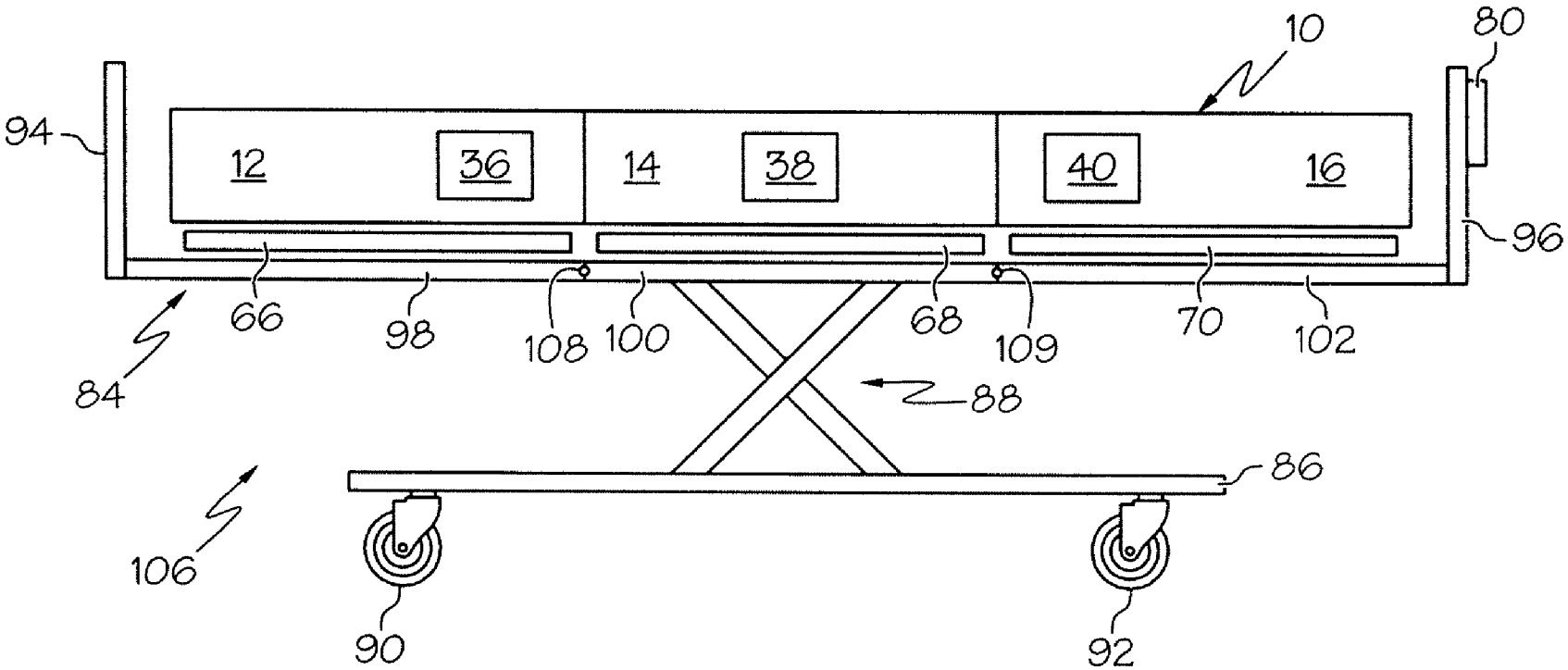
FIG. 2 is a diagrammatic side elevation view of a patient support apparatus including an air control system, positioned on an exemplary bed frame.

A diagram illustrating a side view of a patient support apparatus 106 is shown in FIG. 2. The patient support apparatus or bed 106 includes a mattress assembly 10 positioned on a frame 84. A lift or articulation mechanism 88 (including, for example, a pair of powered lift arms) is configured to raise or lower frame 84 with respect to base 86. At least two wheels or casters 90, 92 are coupled to the base 86 to facilitate movement of the bed 106. Endboards, e.g. headboard 94 and footboard 96, are coupled to frame 84.

Mattress 10 includes one or more mattress sections. As shown in FIG. 2, mattress 10 includes a head mattress section 12, a seat mattress section 14, and a foot mattress section 16. Bed frame 84 includes corresponding frame sections, e.g. head frame section 98, seat frame section 100, and foot frame section 102. Each of the head, seat and foot sections may be independently articulatable. For example, head section 98 may be configured to rotate upwardly around a pivot point 108 to elevate the head section of a patient, and foot section 102 may be configured to rotate downwardly around a pivot point 109 to lower the foot section of a patient. Upwardly rotation of head section 98 and downwardly rotation of foot section 102 may be used to move the bed 106 into a chair-like position. Mattress sections 12, 14, 16 are generally configured to accommodate and/or articulate automatically along with articulation of the bed frame sections 98, 100, 102.

One or more of the mattress sections may include a sensor assembly, which is operably coupled to the mattress and to the mattress control system. In FIG. 2, each of mattress sections 12, 14, 16 includes a sensor assembly, i.e. head sensor assembly 66, seat sensor assembly 68, foot sensor assembly 70. Each sensor assembly includes a pressure sensor for sensing internal bladder pressure. Sensor assemblies 66, 68, 70 are operably coupled to control nodes 36, 38, 40 via a feedback loop to control inflation and deflation of the bladders.

FIG. 2 shows the sensors assemblies 66, 68, 70 as being located underneath the mattress sections 12, 14, 16, although other suitable configurations may be used. For example, sensor assemblies 66, 68, 70 may be integrated with or embedded in mattress sections 12, 14, 16.

Figure 3:
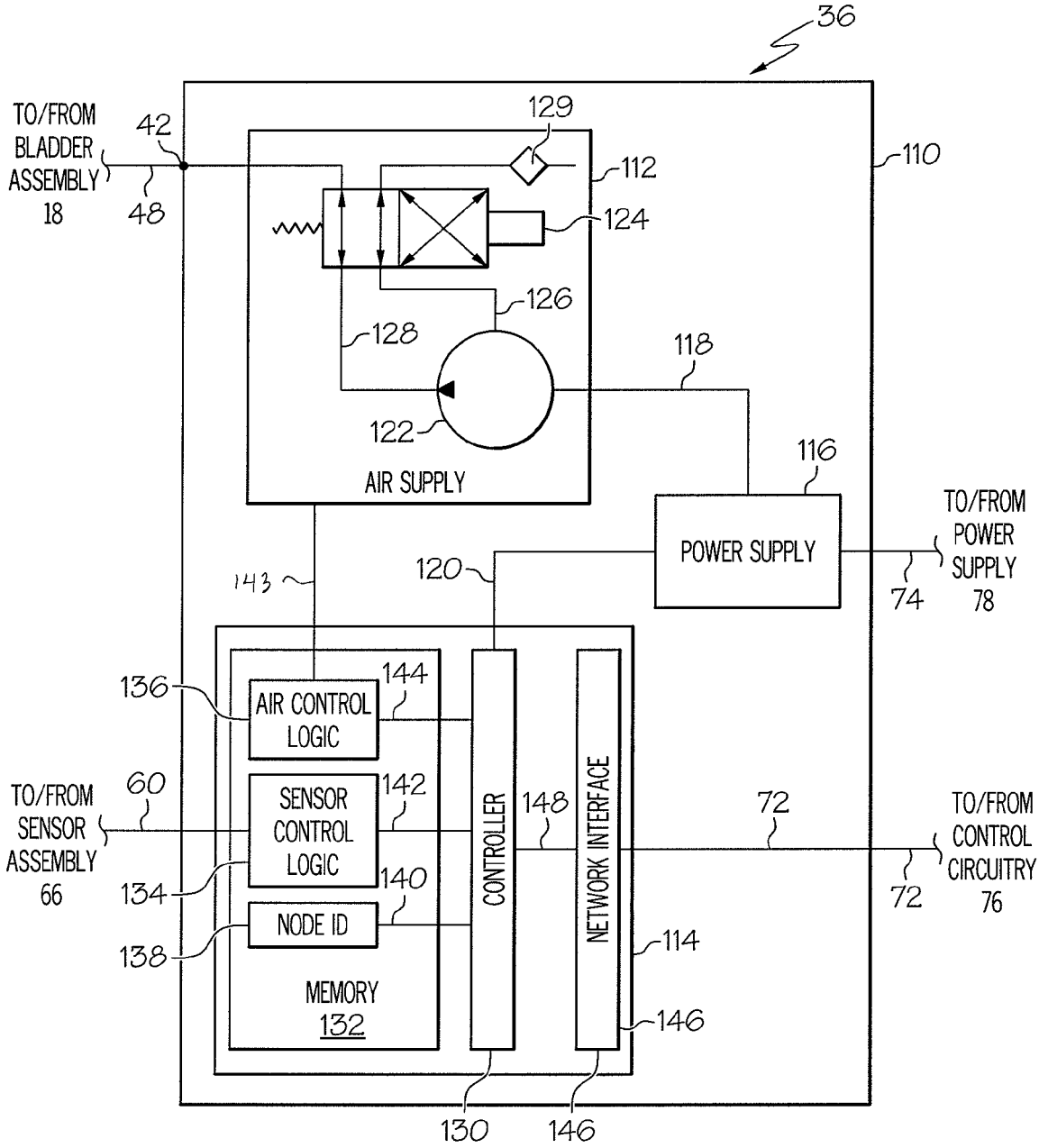
FIG. 3 is a schematic diagram of a control node of a patient support apparatus, including an air supply, a power supply, a microprocessor including a controller, memory, control logic, and network interface, the control node being configured to control a zone of a patient support apparatus.

FIG. 3 is a schematic of a control node 36 individualized to automatically control inflation and deflation of an inflatable mattress zone. Node 36 is configured to reside adjacent to or embedded within mattress section 12 as indicated by FIG. 1. Node 36 is associated with a head section bladder assembly 18 as shown in FIG. 1, but a similar structure may be used in connection with other inflatable zones of a patient support surface.

The illustrated node 36 includes an air supply 112, a processor 114, and a power supply 116. Power supply 116 is electrically connected to air supply 112 via a power conduit 118. Power supply 116 is electrically connected to processor 114 via a power conduit 120. Power supply 116 receives power from external power supply 78 via power conduit 74. Power conduits 74, 118, 120 generally comprise insulated electrical wiring.

Node components 112, 114, 116 may be surrounded by, mounted on, or enclosed in a substrate or housing 110. Housing or substrate 110 may comprise a substantially uniform surface to which each of components 112, 114, 116 are attached. Housing 110 may also include a covering positionable over components 112, 114, 116, such as moisture resistant fabric or molded plastic. Housing 110 may alternatively or in addition comprise urethane-treated foam of a bolster or support packaging (e.g. bolster 30). In general, housing or substrate 110 comprises a force-resistant and moisture-resistant support material. Node components 112, 114, 116 may be secured thereto via adhesive, VELCRO® (hook and loop fastener) or other suitable fastener.

Air supply 112 includes a vacuum/blower 122, a switch valve 124 configured to regulate inflation and deflation of an inflatable mattress zone, an air conduit 126 to atmosphere, an air filter 129 coupled to air conduit 126, and an air conduit 128 coupled to the bladder assembly via switch valve 124, inlet/outlet port 42, and pneumatic connection 48. Dimensions of a vacuum/blower to be integrated with or embedded in a mattress are generally in the range of about 6inches or less in length and in the range of about 1.75 pounds or less in weight. An exemplary micro-sized vacuum/blower is the RL series rotary lobe blower commercially available from Rietschle Thomas, now a division of Gardner Denver, (Thomas Division), of Sheboygan, Wis. A suitable vacuum/blower may be mountable horizontally or vertically to provide for installation in more or less confined areas.

A larger air supply device may be used, particularly if it is not required to be integrated with or embedded in a mattress section. In general, a vacuum/blower that delivers air flow in the range of or up to 2 cfm, pressure in the range of or up to 2 psi, and vacuum in the range of or up to 4 in. hg may be used in connection with an individual mattress section or inflatable zone.

Processor 114 includes a microcontroller 130. Controller 130 accesses memory 132 via data/communication link 140. Memory 130 is a recordable medium in which sensor control logic 134, air control logic 136, and a unique node identifier 138 are stored. Sensor control logic 134 includes executable programming instructions applicable to sensor assembly 66 via data/communication link 60. Air control logic 136 includes executable programming instructions applicable to air supply 112 via data/communication link 143. A network interface 146 is configured to enable processor 114 to communicate with mattress network 4, control circuitry 76, and external network 82 via data/communication link 148. Node identifier 138 is used to uniquely identify a particular control node to the network vis à vis other control nodes that may be provided with the support surface. In general, data/communication links described in this disclosure comprise insulated electrical wiring. In some instances, such as when communication to a remote device is required, a wireless link may be provided.

In operation, controller 130 receives sensor signals from sensor assembly 66 via data/communication link 60. Sensor control logic 134 is applied to the sensor data by controller 130 to determine a sensed pressure value. Air control logic 136 is applied to the pressure value to determine whether a triggering event has occurred. If a triggering event has occurred, controller 130 sends a control signal to air supply 112 via data/communication link 143 and/or sends a control signal including unique identifier 138 to mattress network 4. In the latter case, control circuitry 76 may be applied to determine whether a message needs to be sent to any of the other control nodes 38, 40 and/or to bed network 82, and to transmit such message or messages to other control nodes or to an external network as needed.

Similarly, data or control signals may be received by node 36 from one or more other nodes 38, 40 or from bed frame 82 via network interface 146. In such event, control circuitry 76 and/or air control logic 136 resident in control node 36 is applied to the data or control signals to determine whether a triggering event has occurred external to the inflatable zone 18, which is controlled by control node 36. If a triggering event has occurred, controller 130 signals air supply 112 to take the appropriate action as determined by logic 76 and/or 136.

As can be inferred from the above description, "triggering events" may include events relating to a condition of a bladder (e.g., pressure going above or below a threshold value), a sensor (e.g., patient movement detected), or a device that is external to the control node, such as another control node (e.g., control node is added/removed), another inflatable zone (e.g. turning bladder is inflating/deflating), a sensor assembly associated with another mattress section (e.g., patient exit detected), a bed frame section (e.g., head frame section raised, foot frame section lowered), or a medical device connected to the bed (e.g., IV inserted, defibrillator active, etc.). Structure and operation of control nodes 38, 40 is generally similar to control node 36.

Figure 4:
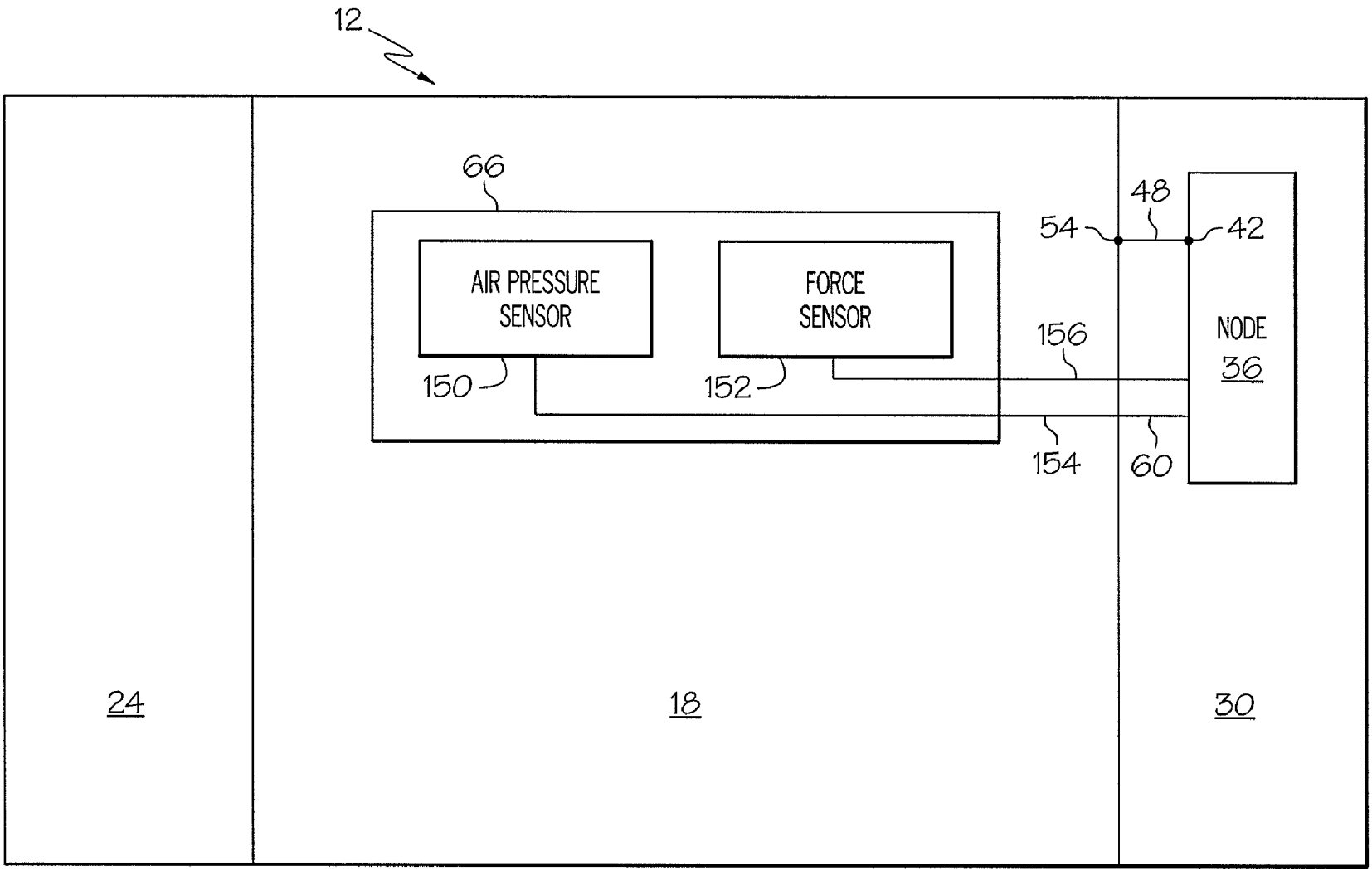
FIG. 4 is a schematic diagram of a mattress section including a sensor assembly coupled to a control node located within the mattress section; where the sensor assembly includes a pressure sensor and a force sensor and the control node is also pneumatically coupled to an air bladder of the mattress section.

FIG. 4 is a schematic of head section mattress zone 12 but a similar structure may also be implemented in other inflatable zones of the mattress. As shown in FIG. 4, one or more force sensors 152 may be provided to sense pressure applied to a bladder section (i.e. interface pressure). Interface pressures may be monitored over time to detect patient ingress or egress from the mattress, or to detect changes in the position of a patient on the mattress. Interface pressures may also be monitored over time and used to make adjustments in the internal bladder pressures.

In FIG. 4, pressure sensor 150 and force sensor 152 are operably coupled to control node 36 via data/communication links 154, 156, respectively. The data received by the control nodes may be used to determine patient positioning through programming logic that relates to patient movement, patient weight, and patient acuity. Particular examples of mattresses including force sensors and monitoring are shown and described in U.S. Patent Application Publication No. 2006/0112489, to Bobey et al., application Ser. No. 11/324,520, titled PATIENT SUPPORT, filed Jan. 3, 2006, and U.S. Patent Application Publication No. 2006/0075559, to Skinner et al., application Ser. No. 11/119,991, titled PATIENT SUPPORT HAVING REAL TIME PRESSURE CONTROL, filed May 2, 2005, and U.S. Patent Application Publication No. 2005/0273940 to Petrosenko et al., application Ser. No. 11/119,635, titled LACK OF PATIENT MOVEMENT MONITOR AND METHOD, filed May 2, 2005, all of which are incorporated by reference herein.

Figure 5:
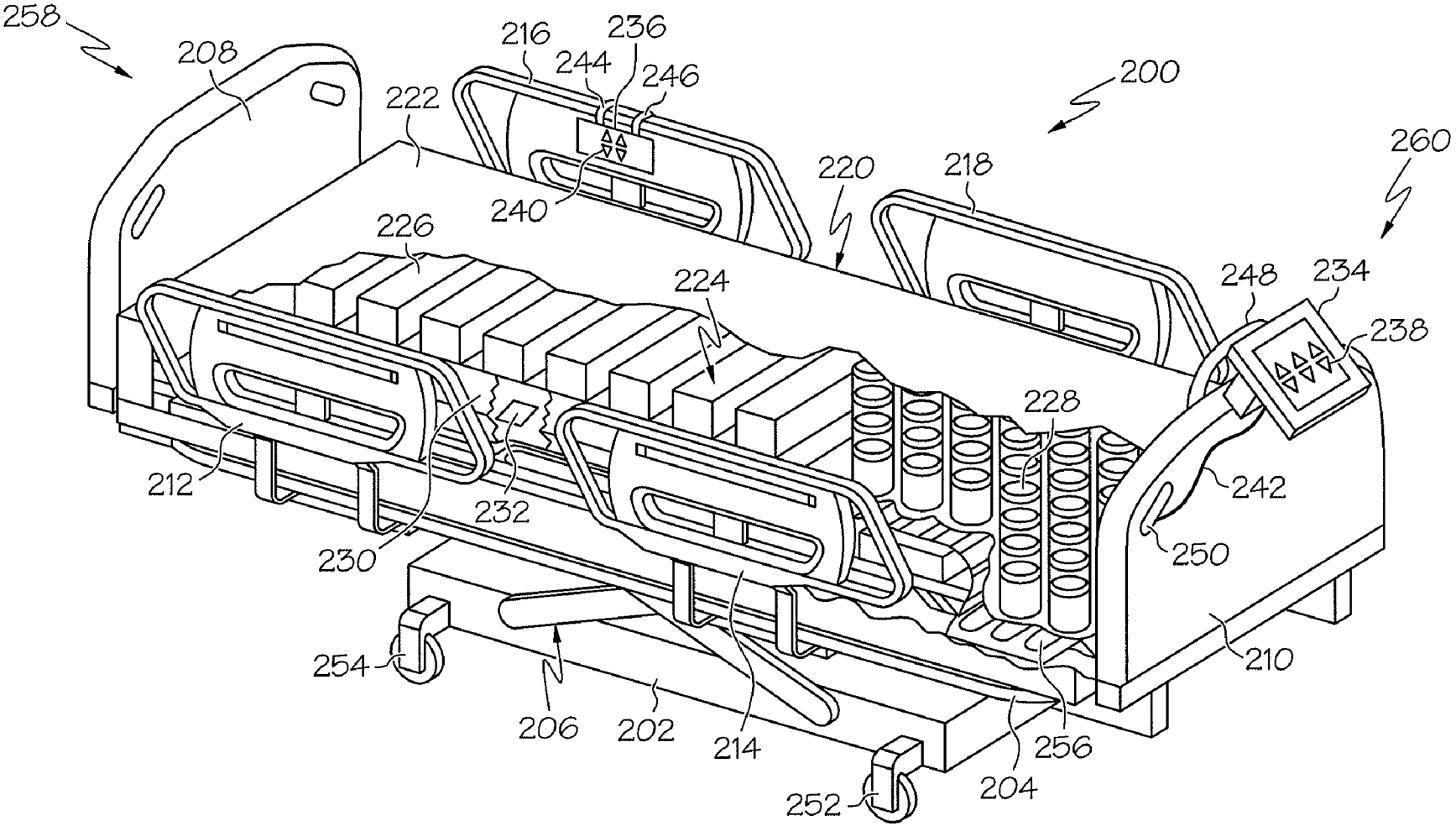
FIG. 5 is a perspective view of a patient support apparatus with portions cut away to show interior components, including a plurality of inflatable bladders, and a control node associated with at least one of the bladders.

Referring now to FIGS. 5-8, exemplary embodiments of a patient support apparatus 200, 300, 400, 500 including a localized air control system are shown. In FIG. 5, a bed 200 is shown. Bed 200 has a head end 258 configured to support a patient's head and/or upper body region, and a foot end 260 longitudinally spaced from the head end 258, the foot end 260 being configured to support a patient's feet and/or lower body region.

Patient support apparatus 200 includes a base 202, a frame 204 coupled to base 202 via a lift mechanism 206, a head endboard 208 and a foot endboard 210, head section siderails 212, 216, foot section siderails 214, 218, and pairs of casters 252, 254. A patient support surface 220 is supported by frame 204. Patient support surface 220 includes a cover 222 which defines an interior region. The interior region includes a plurality of inflatable bladders 224 and a sensor apparatus 256. In the embodiment of FIG. 5, a combination of log-shaped bladders 226 and can-shaped bladders 228 is provided. Support packaging or bolster 230 is positioned along an outer edge of bladders 224 and extends longitudinally along at least a portion of the length of the support surface 220.

A control node 232 provides air control for bladders 226. A second control node (not shown) may provide air control for bladders 228. Control node 232 includes a micro-sized air supply, power supply, and an integrated microprocessor as described above. Control node 232 is disposed within the interior region of the support surface 220. In the embodiment of FIG. 5, control node 232 is disposed adjacent the perimeter of a longitudinal side of the support surface 220 and proximate an upper body region of the patient support. Control node 232 is disposed within support packaging 230 as shown.

Control node 232 is coupled to caregiver control 234 via data/communication link 242, which is routed through footboard aperture 250 in the illustrated embodiment. Caregiver control 234 is supported by footboard 210 via a mount or bracket or coupler 248. Coupler 248 may be configured so that caregiver control 234 may alternatively be supported by a siderail 212, 214, 216, 218. Patient control 236 is supported by a siderail 216 via couplers 244, 246. Data/communication link from control node 232 to patient control 236 comprises wiring routed through one of couplers 244, 246 or routed through an interior region of the siderail, and/or may comprise a wireless connection.

Caregiver control 234 includes one or more control buttons or switches 238, and patient control 236 likewise includes one or more buttons or switches 240, to activate or deactivate various features or functions of the mattress 220 as described above.

Figure 6:
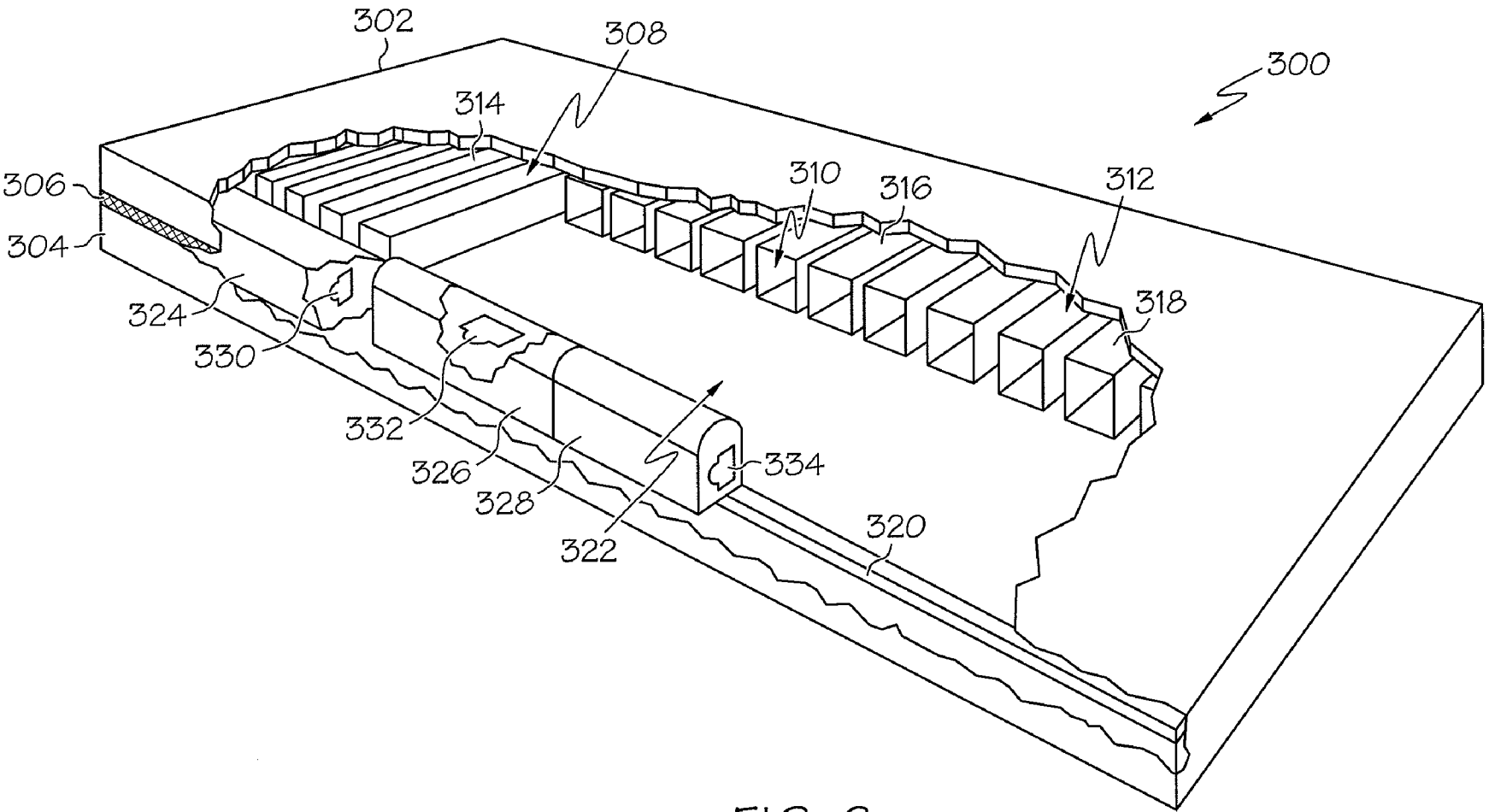
FIG. 6 is a perspective view of a patient support surface having a plurality of controllable support zones, with portions cut away to show internal components including embedded control nodes.

In the embodiment of FIG. 6, patient support surface 300 includes a top cover 302, a bottom cover 304, and a fastener 306 (zipper, snaps, VELCRO® (hook and loop fastener), buttons, rivets, stitching, or the like) configured to join top cover 302 and bottom cover 304 to form an interior region 322. Surface 300 includes a plurality of mattress sections including a first section 308, a second section 310, and a third section 312 located in interior region 322. Support packaging or bolsters 324, 326, 328 and a sensor pad 320 are also located in interior region 322.

First mattress section 308 includes a first bladder assembly 314, second mattress section 310 includes a second bladder assembly 316, and third mattress section 312 includes a third bladder assembly 318. Each bladder assembly 314, 316, 318 includes a plurality of transversely oriented or log-shaped inflatable bladders.

A control node 330, 332, 334 is associated with each mattress section. In particular, first control node 330 is located in first bolster section 324 and is operably coupled to first bladder assembly 314; second control node 332 is located in second bolster section 326 and is operably coupled to second bladder assembly 316; and third control node 334 is located in third bolster section 328 and is operably coupled to third bladder assembly 318. First control node 330 controls inflation and deflation of the first bladder assembly 314, second control node 332 controls inflation and deflation of the second bladder assembly 316, and third control node 334 controls inflation and deflation of the third bladder assembly 318 as described above.

Figure 7:
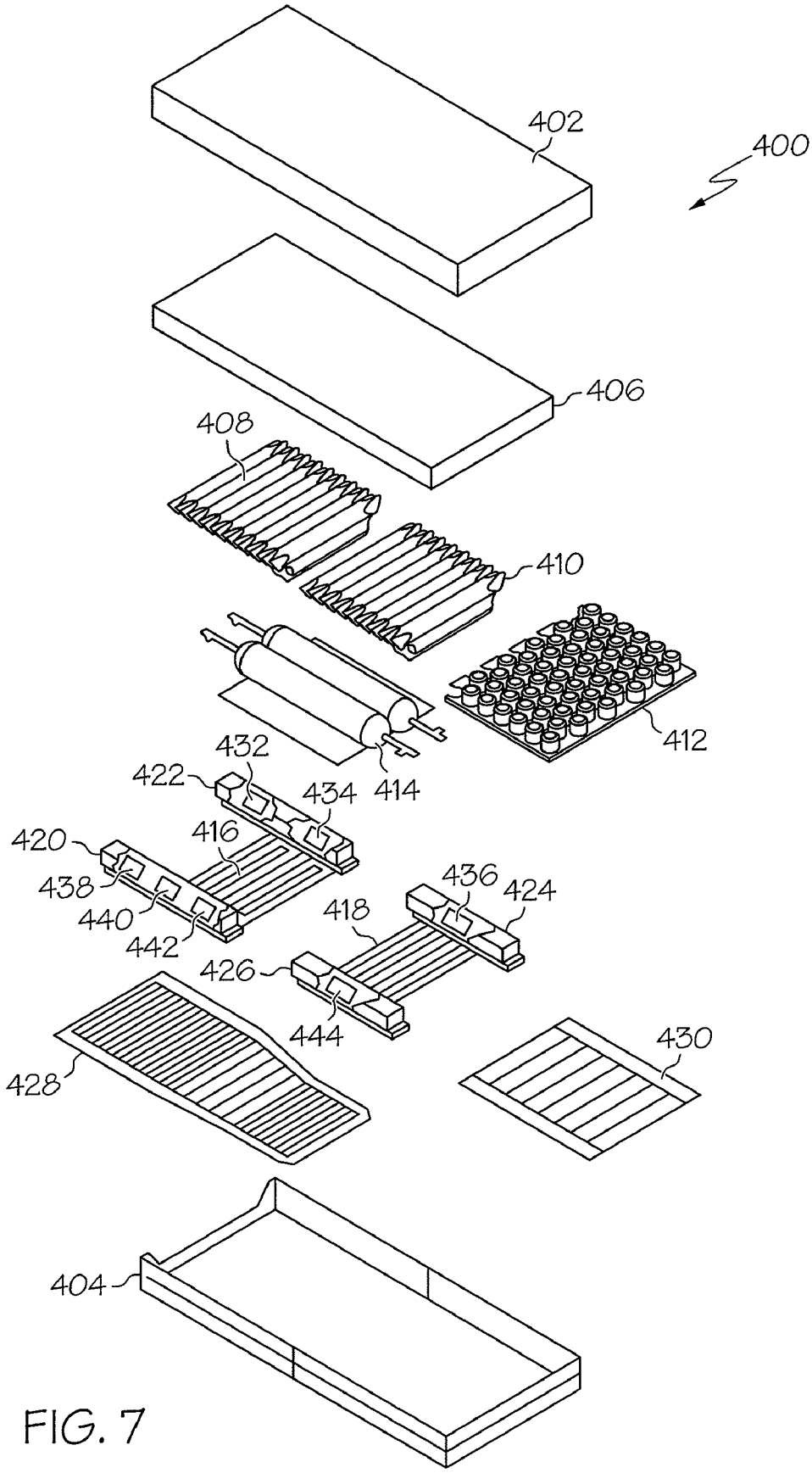
FIG. 7 is an exploded perspective view of a patient support surface including a plurality of mattress sections and associated control nodes.

FIG. 7 is a simplified exploded view of internal components of a patient support surface 400. Patient support surface 400 includes a top cover 402 and a bottom cover 404 joinable to provide an interior region. A plurality of layers are provided within the interior region of the support surface 400. A first layer 406 includes a non-inflatable support material. A second layer includes a plurality of inflatable bladders assemblies 408, 410, 412 located underneath the first layer 406. A third layer includes a pressure sensing assembly 416,418 located underneath bladders assemblies 408, 410 of the second layer.

The non-inflatable material of first layer 406 may include a fire sock, foam, one or more layers of an air permeable three-dimensional material, LYCRA® (spandex) or similar material. Suitable three-dimensional materials include SPACENET® (generic terminology not known), TYTEX® (generic terminology not known), and/or similar materials.

In the illustrated embodiment, the second support layer includes a head section bladder assembly 408, a seat section bladder assembly 410, and a foot section bladder assembly 412. First bladder assembly 408 and second bladder assembly 410 include transverse or log shaped bladders. Third bladder assembly 412 includes upright can- or cylinder-shaped bladders. The bladders of each bladder assembly may be coupled together by an integrated base such that they may be removable together as a zone. Communication of fluid to or from the bladders is generally provided by a plenum and ports provided for each mattress zone, which are adapted to be coupled to an air inlet/outlet port of the corresponding control node 432, 434, 436.

In the illustrated embodiment, turning bladders 414 are positioned below the second layer. Turning bladders 414 generally include a pair of longitudinally oriented inflatable bladders, which may be alternately inflated at the discretion of a caregiver to assist the caregiver with turning a patient onto his or her side on the patient support. Activation of turning bladders 414 is controlled by an authorized caregiver via a caregiver user interface.

A pressure-sensing layer including first and second sensing assemblies, namely a head sensor assembly 416 and a seat sensor assembly 418, is positioned substantially beneath bladder assemblies 408 and 410. Additional sensing assemblies may also be provided in other zones defined within the interior region, such as the foot section of the patient support surface. Data from the sensor assemblies may be used to determine whether to adjust pressure in one or more of the bladders or to activate or deactivate mattress features or therapies, as described above. In general, insulated wiring connects each sensor assembly to the corresponding control node.

The support surface of FIG. 7 also includes inflatable filler bladder assemblies 428, 430. These support components may be provided to enable support surface 400 to be used in connection with a variety of different bed frames, in particular, a variety of bed frames having different deck configurations. One or more of these support components may be selectively inflated or deflated or added to or removed from support surface 400 in order to conform the surface to a particular deck configuration, such as a step deck or recessed deck or a flat deck. In general, bladder assemblies 408, 410, 412, 414, 428, 430 are formed from a polyurethane coated nylon twill.

Non-inflatable support packaging or bolsters 420, 422, 424, 426 are disposed on either longitudinal side of the support surface 400. Control nodes 432, 434, 436, 438, 440, 442, 444 are installed in the packaging 420, 422, 424, 426. For example, packaging 420, 422, 424, 426 may include foam having hollowed-out cavities sized to receive the control nodes. One control node is provided for each inflatable zone of the patient support 400. For example, control node 432 provides air control for first bladder assembly 408, control node 434 provides air control for second bladder assembly 410, control node 436 provides air control for third bladder assembly 412, control nodes 438 and 440 provide air control for the first and second turning bladders 414, respectively, control node 442 provides air control for filler bladder 428, and control node 444 provides air control for filler bladder 430, as described above.

Figure 8:
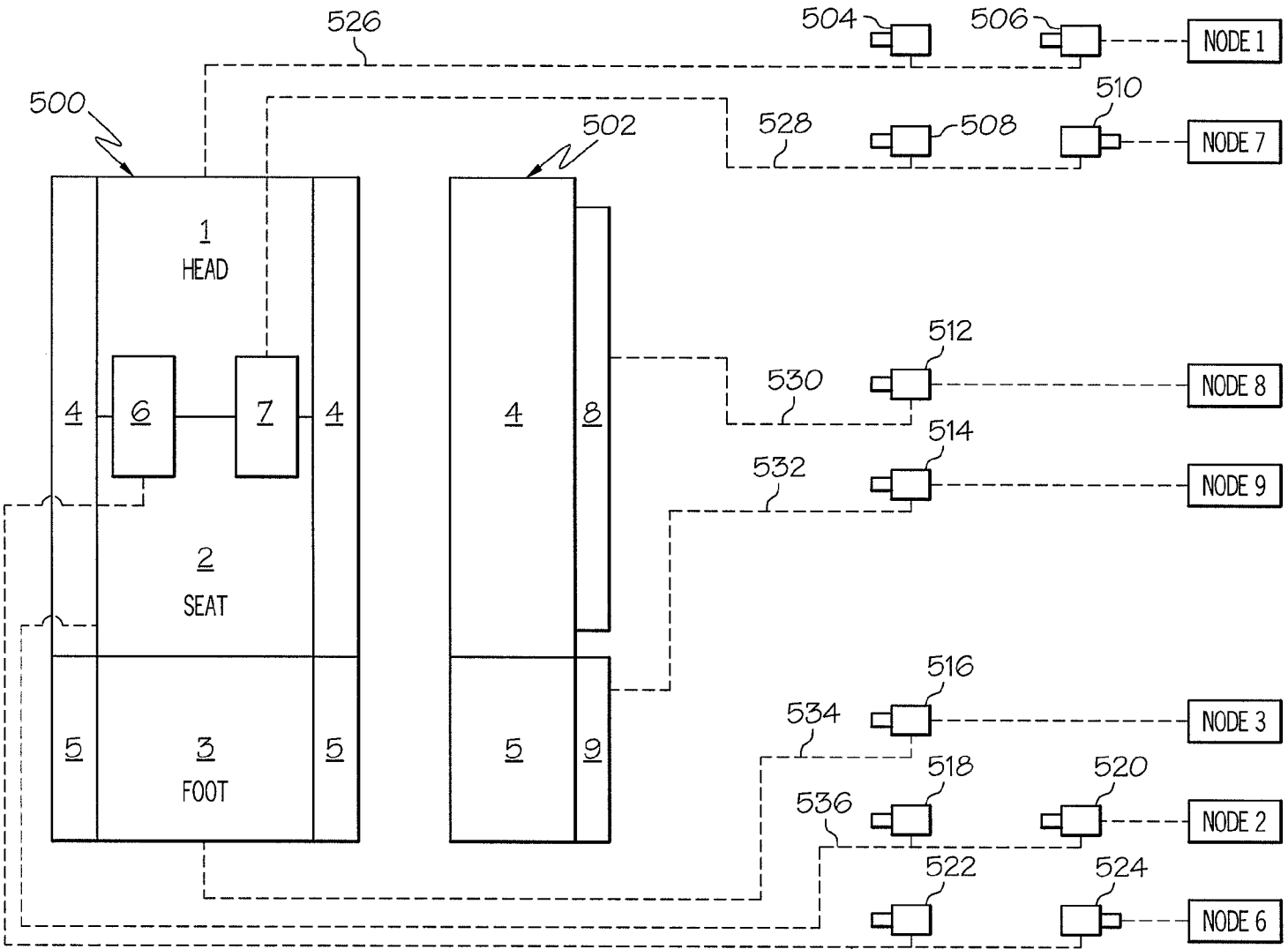
FIG. 8 is a schematic diagram of a patient support surface including a plurality of inflatable sections, a plurality of control nodes, and pneumatic connections between the inflatable sections and the control nodes.

FIG. 8 further illustrates the pneumatic connections between the nodes and bladder assemblies of FIG. 7. Element 500 represents a bottom diagrammatic view of inflatable zones and element 502 represents a side elevation showing orientation of the inflatable zones. A plurality of control nodes 1,2,3,6,7,8,9 are pneumatically connected to a plurality of corresponding inflatable zones 1,2,3,6,7,8,9 of surface 500 for inflating and deflating bladders disposed in each zone. Node 1 controls the amount of air in the bladders located in the head zone 1. Head valve module 504 is controlled by control node 1 to control air flow to and from the bladders in head zone 1. When the bladders in head zone 1 are deflated, air transfers from the bladders through head vent valve module 506 and is released to atmosphere through a vent (not shown). Similarly, seat valve module 508 and seat vent valve module 510 control the inflation and deflation of the inflatable bladders in the seat zone 2; left turn assist valve module 522 and left turn assist vent valve module 524 control the bladders in the left turn assist zone 6; and right turn assist valve module 508 and right turn assist vent valve module 510 control the inflation and deflation of bladders in the right turn assist zone 7.

In the illustrated embodiment, the bladders in the foot zone 3 are inflated and deflated by air transferred through foot valve module 516. Similar air distribution arrangements exist with the step deck filler zone 8, and foot deck filler zone 9. In each of these zones, air passes through corresponding valves, including step deck filler valve module 512 and foot deck filler valve module 514. Air conduits or tubes 526, 528, 530, 532, 534, 536, 538 connect each inflatable zone and corresponding valve assembly to the localized air supply of the respective control nodes as shown and described.

Alternatively, a direct pneumatic connection is made between the air supply of each localized control node and the corresponding bladder assembly, thereby eliminating the need for additional valve assemblies 504, 506, 508, 510, 512, 514, 516, 518, 520, 522, 524. In such case, the inlet/outlet ports of the node air supplies 1,2,3,6,7,8,9 connect directly to the inlet/outlet ports of the bladder assemblies via an elbow or other suitable pneumatic coupling.

This disclosure describes certain embodiments, features, combinations, and applications relating to the present invention. The scope of patentable subject matter may include modifications and variations of such embodiments, features, combinations, and applications within the spirit of the present invention.

The invention claimed is:

1. A patient support surface comprising:

a cover defining an interior region;

a plurality of inflatable zones located in the interior region;

a plurality of air control nodes located in a non-inflatable portion of the interior region adjacent each of the inflatable zones, each node being associated with a zone, each node including an air supply pneumatically coupled to one of the zones, a power supply which powers the air supply, a processor operable to execute programming logic configured to control air flow between the air supply and the zone, and a network interface configured to receive data or control signals directly from one or more other air control nodes; and control circuitry configured to enable communication between any of the air control nodes and an external bed network relating to a condition of a bed frame, wherein each control node communicates data indicating a condition of the associated inflatable zone to the bed network to enable the bed frame to respond to the condition of the inflatable zone.

2. The patient support surface of claim 1, wherein each node includes a micro-sized vacuum/blower.

3. The patient support surface of claim 1, wherein each node has a node identifier that is different from the other node identifiers.

4. The patient support surface of claim 1, wherein each node includes a network interface to communicate with the other nodes over a network.

5. The patient support surface of claim 1, further comprising at least one user interface to selectively control the nodes by a user.

6. The patient support surface of claim 1, further comprising a plurality of pressure sensors in data communication with the control nodes, wherein the sensors are configured to sense pressure in the inflatable zones and output signals indicative of sensed pressure values to the control nodes, and the programming logic is applied to the sensed pressure values to control air flow to and from the zones.

7. The patient support surface of claim 1, further comprising a plurality of force sensors in data communication with the control nodes, wherein the force sensors are configured to sense force applied to the inflatable zones and output signals indicative of the sensed force values to the control nodes, and the programming logic is applied to the sensed force values to control air flow to and from the zones.

8. The patient support surface of claim 1, wherein each node includes a recordable medium and the programming logic is stored in the recordable medium of the control node.

9. A mattress assembly comprising:

a cover defining interior region, the interior region comprising a plurality of inflatable zones including a head zone configured to support an upper body portion of a patient and a seat zone configured to support a seat portion of a patient, each of the zones having a first side and a second side transversely spaced from the first side, and a non-inflatable support member positioned adjacent one of the sides of the inflatable zones along a longitudinal axis of the mattress assembly, the non-inflatable support member comprising a plurality of non-inflatable zones, wherein the non-inflatable support member includes at least one control node located in an interior region of each non-inflatable zone of the non-inflatable support member and operably coupled to at least one of the zones to control air flow in the at least one inflatable zones.

10. The mattress assembly of claim 9, wherein the control node is located adjacent one of the longitudinal sides of the head zone of the mattress assembly.

11. The mattress assembly of claim 9, wherein the non-inflatable support member comprises foam and includes a recess sized to receive the control node.

12. The mattress assembly of claim 9, wherein the control node includes a micro-sized vacuum/blower and a processor configured to control operation of the micro-sized vacuum/blower.

13. The apparatus of claim 9, wherein the interior region further comprises a first layer of non-inflatable material extending between the first and second sides of each zone and extending along a longitudinal length of the mattress assembly and wherein the plurality of inflatable zones cooperate to form a second layer supporting the first layer.

14. An air control system for a patient support surface having a plurality of bladder assemblies, the air control system comprising:

a first control node including a first memory, a first node identifier stored in the first memory, a first pneumatic coupling configured to couple the first control node to a first bladder assembly of a patient support surface, a first air supply configured to supply air flow to the first bladder assembly via the first pneumatic coupling, a first processor configured to receive air control data, apply first air control logic to the air control data, and control operation of the first air supply in consideration of the air control data, and a first network interface;

a second control node including a second memory, a second node identifier stored in the second memory, the second node identifier being different than the first node identifier, a second pneumatic coupling configured to couple the second control node to a second bladder assembly of a patient support surface, a second air supply configured to supply air flow to the second bladder assembly via the second pneumatic coupling, a second processor configured to receive air control data, apply second air control logic to the air control data, and control operation of the second air supply in consideration of the air control data, and a second network interface configured to receive data or control signals from the first network interface;

a non-inflatable support member comprising a plurality of non-inflatable zones, the first and second control nodes each being located in different non-inflatable zones of the non-inflatable support member; and a communication link configured to permit electronic communication between the first control node and the second control node.

15. The system of claim 14, wherein the air control data includes sensed bladder pressure in a bladder assembly and sensed force applied to a bladder assembly.

16. The system of claim 14, wherein the air control data includes data relating to a third bladder assembly.

17. The system of claim 14, wherein the air control data includes data relating to a position of a bed frame section relative to the horizontal.

18. A patient support apparatus comprising:

a mattress including a plurality of inflatable bladder assemblies, an air control system operably coupled to the mattress, the air control system including a plurality of control nodes, wherein each control node includes an air supply, a power supply which powers the air supply, a processor configured to control air flow between the air supply and one of the bladder assemblies, a network interface configured to provide data communication among the control nodes, and a non-inflatable support member positioned adjacent a side of at least one of the inflatable bladder assemblies, the non-inflatable support member comprising a plurality of non-inflatable zones, the control nodes each being located in an interior region of different non-inflatable zones.

19. The apparatus of claim 18, further comprising control circuitry configured to link a first network with a second network.

20. The apparatus of claim 19, wherein the second network is an external network associated with a bed frame.

21. The apparatus of claim 19, further comprising at least one user control operably coupled to the control circuitry to communicate user instructions to a control node associated with an inflatable zone selected by a user.

* * * * *